US007588242B1

(12) United States Patent
Reidhaar

(10) Patent No.: US 7,588,242 B1
(45) Date of Patent: Sep. 15, 2009

(54) DRIVE APPARATUS FOR DRIVING MEDIA SHEETS IN A PRINTING DEVICE

(75) Inventor: Glen Alan Reidhaar, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 12/057,528

(22) Filed: Mar. 28, 2008

(51) Int. Cl.
*B65H 5/22* (2006.01)
*B65H 83/00* (2006.01)
*B65H 85/00* (2006.01)

(52) U.S. Cl. ..... 271/3.14; 271/3.01

(58) Field of Classification Search ..... 271/3.01, 271/3.14

See application file for complete search history.

(56) References Cited

U.S. PATENT DOCUMENTS 5,937,262 A * 8/1999 Cho ..... 399/401

7,274,903 B2 * 9/2007 Carter et al. ..... 399/320

* cited by examiner

*Primary Examiner*—Patrick H Mackey
*Assistant Examiner*—Prasad V Gokhale
(74) *Attorney, Agent, or Firm*—Jay M. Schloff

(57) ABSTRACT

A drive apparatus for driving media sheets in a printing device is disclosed. The drive apparatus includes a fuser drive train, a duplexer drive train, an exit roll gear and a bell crank. The bell crank is at least partially disposed in-between the fuser drive train and the duplexer drive train and is capable of swinging to assume one of a first position and a second position. The bell crank in the first position couples the fuser drive train to the exit roll gear driving the exit roll gear in the first direction for driving a media sheet into an output bin of the printing device. The bell crank in the second position couples the duplexer drive train with the exit roll gear driving the exit roll gear in the second direction for driving the media sheet along a redrive path into the printing device.

15 Claims, 5 Drawing Sheets

DRIVE APPARATUS FOR DRIVING MEDIA SHEETS IN A PRINTING DEVICE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The invention relates generally to printing devices, and, more particularly, to a drive apparatus in a printing device for driving media sheets in the printing device.

2. Description of the Related Art

Printing devices commonly referred to as printers, are widely used in offices, in homes and in business enterprises. The printing devices output information displayed on a screen of a data processing device onto a media sheet such as a sheet of paper. The printing devices as used herein may encompass printing systems such as color and black-and-white copiers, color and black-and-white printing systems, and so-called 'all-in-one devices' that incorporate multiple functions such as scanning, copying, and printing capabilities in one device. The term output as used herein may encompass any printed or digital form of text, graphic, or combination thereof.

The printing devices may be configured to suit a variety of applications. For instance, an application being executed on the data processing device may desire printing of the information on only one-side (simplex printing) of the media sheet while another application may desire printing of the information on both sides (duplex printing) of the media sheet. The printing devices may accordingly be configured to provide such output. Typically, for duplex printing, most of the printing devices follow a procedure of printing a first side of a media sheet in a printing region of a media path and partially exiting the media sheet from the media path while retaining at least a portion of the media sheet at an exit nip with the help of exit rolls. Thereafter, the direction of rotation of the exit rolls is reversed and the media sheet is inserted back into the media path of a printing device to perform the printing on a second side of the media sheet. Further, the media sheet is exited from the exit nip into an output bin of the printing device after completion of printing on both sides of the media sheet. The above printing operation may be referred to as a 'peek-a-boo type of duplex turnaround printing' as a portion of the media sheet is partially exited from the printing device and turned around by re-inserting in the printing device in order to print the second side of the media sheet.

Configuring the printing device for duplex printing requires a complex mechanism of gears for driving the media sheet in one-direction and then reversing direction of the exit rolls for driving the media sheet back along the media path, referred to as a redrive path, in the printing device. In addition to motors which drive the media sheet, such as a fuser motor, a duplexer motor and the like, a dedicated actuator such as a motor or a solenoid is typically used for reversing the direction of the exit rolls for driving the media sheet back along the redrive path in the printing device. Using the dedicated actuator increases cost, noise and power consumption of the printing device.

Further, if the duplexer motor is used to drive the exit rolls, it is held in operation even during simplex printing of the media sheet resulting in an increase in cost of operation along with an increase in noise and power consumption of the printing device. Furthermore, existing printing devices, which drive the exit rolls with the duplexer motor, preclude provisions for autonomy for the duplexer motor for driving the media sheet back along the redrive path in the printing device.

Based on the foregoing, there is a need for a printing device that precludes the need of a dedicated actuator for reversing the direction of the exit rolls for driving the media sheet back along the redrive path in the printing device. Further, the printing device should permit the duplexer motor to participate in driving the exit rolls without having to drive the exit rolls during simplex printing of the media sheet. Furthermore, the printing device should permit the duplexer motor autonomy to drive the media sheet back along the redrive path in the printing device, thereby allowing the duplexer motor to vary speed of the media sheet in redrive into the printing device.

SUMMARY OF THE INVENTION

In view of the foregoing disadvantages inherent in the prior art, the general purpose of the present invention is to provide a printing device including a drive apparatus for driving media sheets in the printing device to include all the advantages of the prior art, and to overcome the drawbacks inherent therein.

In one aspect, the present invention provides a drive apparatus for driving media sheets in a printing device. The drive apparatus includes a fuser drive train, a duplexer drive train, an exit roll gear and a bell crank. The fuser drive train includes a fuser pinion gear, a fuser concentric idler gear and a fuser engaging idler gear. The duplexer drive train includes a duplexer pinion gear, a duplexer concentric idler gear and a duplexer engaging idler gear. The fuser pinion gear is capable of being driven by a fuser motor input. The fuser concentric idler gear revolves on a frame mounted shaft and is configured in a mating relationship with the fuser pinion gear. The fuser engaging idler gear revolves on a first shaft and is configured in a mating relationship with the fuser concentric idler gear. The fuser engaging idler gear is capable of driving the exit roll gear in a first direction. The duplexer pinion gear is capable of being driven by a duplexer motor input. The duplexer concentric idler gear revolves on the frame mounted shaft and is configured in a mating relationship with the duplexer pinion gear. The duplexer engaging idler gear revolves on a second shaft and is configured in a mating relationship with the duplexer concentric idler gear. The duplexer engaging idler gear is capable of driving the exit roll gear in a second direction, opposite to the first direction.

The bell crank is swingably mounted on the frame-mounted shaft and is at least partially disposed in-between the fuser concentric idler gear and the duplexer concentric idler gear. The bell crank includes a first lateral surface and a second lateral surface. The first shaft is mounted on the first lateral surface and the second shaft mounted on the second lateral surface. The bell crank is capable of swinging to assume one of a first position and a second position. The bell crank in the first position is capable of coupling the fuser engaging idler gear to the exit roll gear for driving the exit roll gear in the first direction. The bell crank in the second position is capable of decoupling the fuser engaging idler gear from the exit roll gear and coupling the duplexer engaging idler gear with the exit roll gear for driving the exit roll gear in the second direction.

The exit roll gear driven in the first direction is capable of driving a media sheet partially or completely into an output bin of the printing device. The exit roll gear in the second direction is capable of driving the media sheet along a redrive path into the printing device.

In another aspect, the present invention provides a method for driving media sheets in a printing device. The method includes providing a fuser motor input for driving a fuser drive train to drive the exit roll gear in the first direction. The duplexer motor input is provided based on pre-defined criterion for driving a duplexer drive train. The duplexer motor input provided to the duplexer drive train is capable of swinging a bell crank from a first position to a second position. The bell crank is at least partially disposed between the fuser drive train and the duplexer drive train. The bell crank in the first position is capable of coupling the fuser drive train to the exit roll gear for driving the exit roll gear in the first direction. The exit roll gear driven in the first direction is capable of driving a media sheet into an output bin of the printing device. The bell crank in the second position is capable of decoupling the fuser drive train from the exit roll gear and coupling the duplexer drive train to the exit roll gear for driving the exit roll gear in the second direction. The exit roll gear driven in the second direction is capable of driving the media sheet along a redrive path into the printing device. Further, speed of redrive of the media sheet along the redrive path may be varied independent of the fuser motor input by varying the duplexer motor input.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
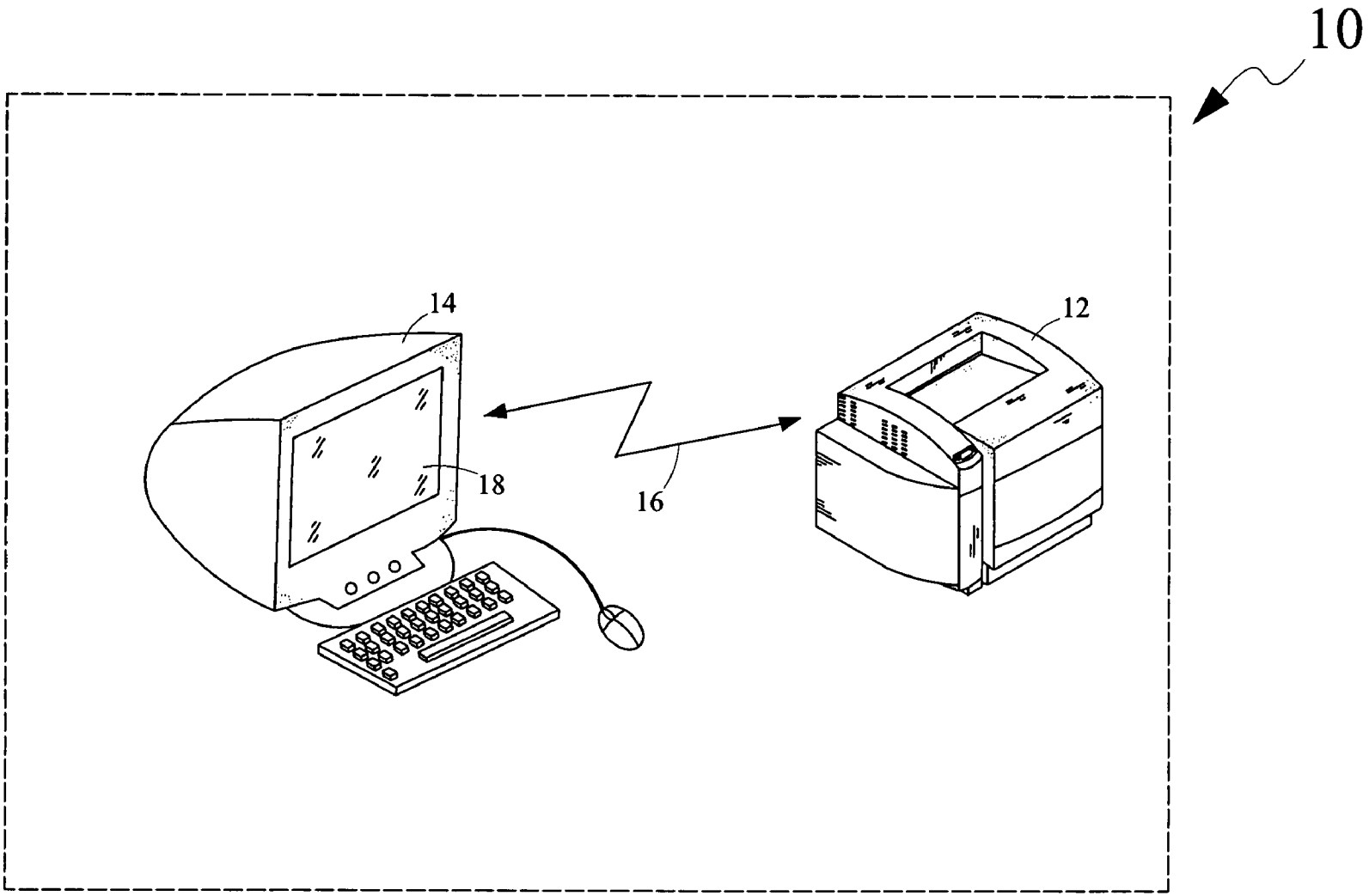
FIG. 1 is a schematic depiction of an exemplary printing system including a printing device embodying the present invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

The present invention provides a drive apparatus for use in a printing device and a method for driving media sheets in the printing device. The drive apparatus includes a fuser drive train, a duplexer drive train, an exit roll gear and a bell crank. The bell crank is at least partially disposed in-between the fuser drive train and the duplexer drive train and is capable of swinging to assume one of a first position and a second position. The bell crank in the first position couples the fuser drive train to the exit roll gear driving the exit roll gear in the first direction for driving a media sheet into an output bin of the printing device. The bell crank in the second position couples the duplexer drive train with the exit roll gear driving the exit roll gear in the second direction for driving the media sheet along a redrive path into the printing device.

Referring now to the drawings and particularly to FIG. 1, there is shown a schematic depiction of an exemplary printing system 10 including a printing device 12 embodying the present invention. Printing system 10 includes printing device 12 and a data processing device 14. Printing device 12 communicates with data processing device 14 via a communication link 16. Printing device 12 may be, for example, an inkjet printer/copier, an electrographic printer/copier, a thermal transfer printer/copier or a so-called 'all-in-one device' that incorporates multiple functions such as scanning, copying, and printing capabilities in one device. Data processing device 14 may be, for example, a computer, a laptop or a personal digital assistant. Printing device 12 may utilize ink jet, dot matrix, dye sublimation, laser, or any other suitable print formats for outputting information displayed on a screen 18 of data processing device 14.

Communication link 16 facilitates electronic communication between printing device 12 and data processing device 14, and may operate using a wired technology or a wireless technology. Printing device 12 may communicate with data processing device 14 via a standard communication protocol, such as for example, Universal Serial Bus (USB), Ethernet or Institute of Electrical and Electronics Engineers (IEEE) 802.xx.

Those skilled in the art will recognize that printing device 12 may include typical components such as, for example, a controller, an input media tray, one or more printing cartridges, a user interface, drive rolls for driving media sheet in printing device 12 and one or more motors for driving the drive rolls. The controller may include, for example, a processor unit and an associated memory and may be formed as one or more Application Specific Integrated Circuit (ASIC). Memory, may be, for example, a random access memory (RAM), a read only memory (ROM), and/or a non-volatile RAM (NVRAM). Alternatively, memory may be in form of a separate electronic memory (e.g., RAM, ROM, and/or NVRAM), a hard drive, a CD or DVD drive, or any memory device convenient for use with the controller. The controller may be configured to process input received using the user interface and provide instructions for printing on the media sheets, such as a sheet of paper. Printing device 12 may further include a printing region for performing printing operations. In addition to the one or more print cartridges, the printing region may typically include an imaging section and a fusing section known in the art for performing the printing operations.

The media sheets are driven from the input media tray to the printing region and from the printing region to an output bin of printing device 12 using the drive rolls in printing device 12. A drive apparatus for driving the media sheets in printing device 12 embodying the present invention is explained in detail in conjunction with FIGS. 2A and 2B.

Figure 2A:
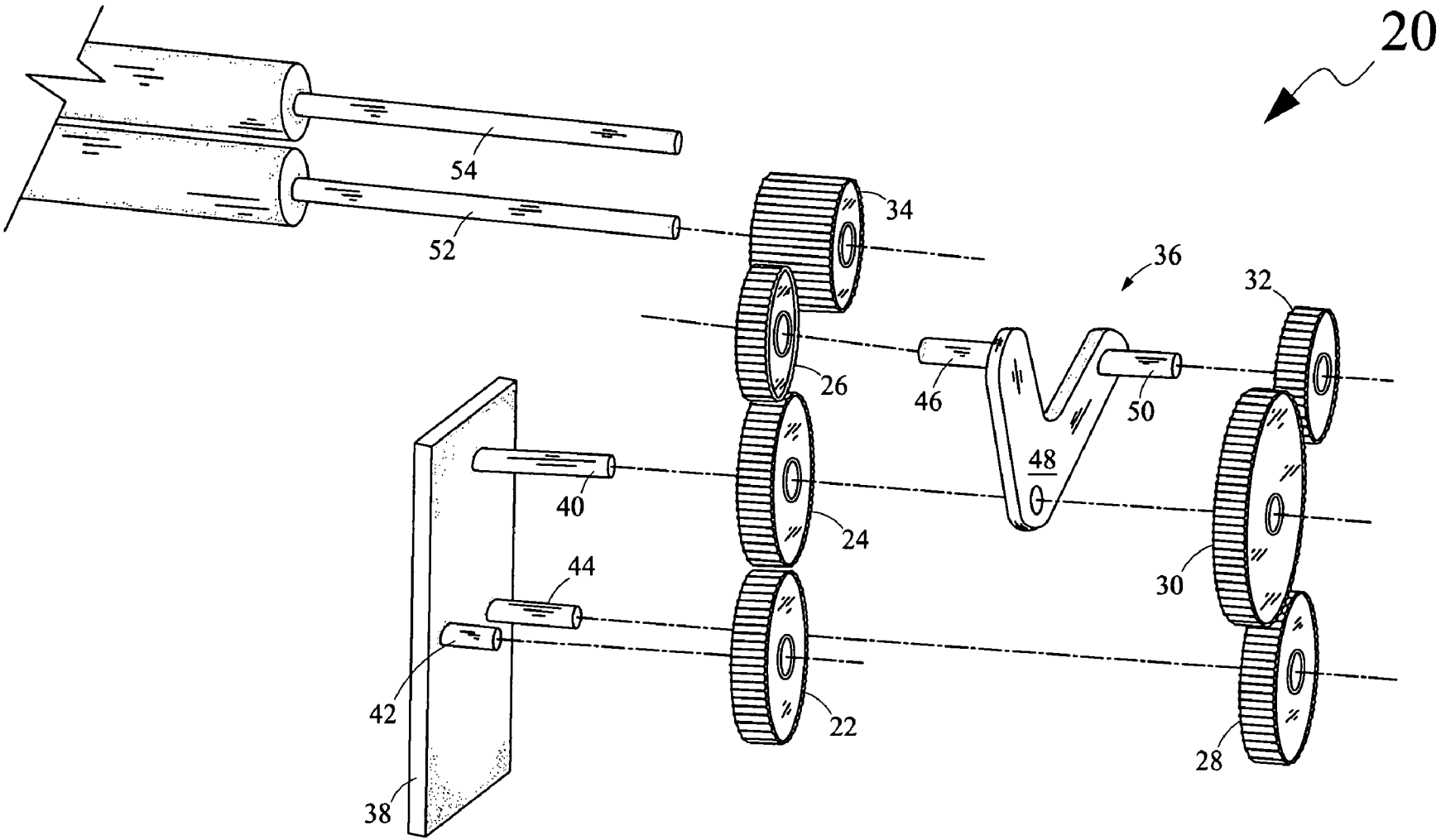
FIG. 2A is a schematic depiction of components of a drive apparatus of a printing device embodying the present invention.

FIG. 2A is a schematic depiction of components of a drive apparatus 20 in printing device 12 embodying the present invention. Drive apparatus 20 includes a fuser pinion gear 22, a fuser concentric idler gear 24, a fuser engaging idler gear 26, a duplexer pinion gear 28, a duplexer concentric idler gear 30, a duplexer engaging idler gear 32, an exit roll gear 34 and a bell crank 36. A frame 38 including a frame-mounted shaft 40, a fuser pinion gear shaft 42 and a duplexer pinion gear shaft 44 is provided in printing device 12 for mounting one or more gears of drive apparatus 20. Bell crank 36 includes a first lateral surface (not shown) for mounting a first shaft 46 and a second lateral surface 48 for mounting a second shaft 50. An exit roll gear shaft 52 capable of mounting exit roll gear 34 is depicted along with a roll gear shaft 54 capable of supporting a roll (not shown) abuttingly coupled to exit roll gear 34 for forming an exit nip (not shown) for driving a media sheet partially or completely into an output bin (not shown) of printing device 12.

Fuser pinion gear 22, fuser concentric idler gear 24 and fuser engaging idler gear 26 together configure a fuser drive train for driving exit roll gear 34 in a first direction for driving a media sheet (not shown) partially or completely into an output bin of printing device 12. Duplexer pinion gear 28, duplexer concentric idler gear 30 and duplexer engaging idler gear 32 together configure a duplexer drive train for driving exit roll gear 34 in a second direction, opposite to the first direction, for driving the media sheet along a redrive path (not shown) into printing device 12.

Fuser pinion gear 22 may be mounted on fuser pinion gear shaft 42 and is capable of receiving a fuser motor input from a fuser motor (not shown). Fuser concentric idler gear 24 may be mounted on frame-mounted shaft 40 and is configured in a mating relationship with fuser pinion gear 22. Fuser engaging idler gear 26 may be mounted on first shaft 46 and is configured in a mating relationship with fuser concentric idler gear 24. Fuser engaging idler gear 26 is capable of driving exit roll gear 34 in the first direction such as a clockwise direction. Duplexer pinion gear 28 may be mounted on duplexer pinion gear shaft 44 and is capable of receiving a duplexer motor input from a duplexer motor (not shown). Duplexer concentric idler gear 30 may be mounted on frame-mounted shaft 40 and is configured in a mating relationship with duplexer pinion gear 28. Duplexer engaging idler gear 32 may be mounted on second shaft 50 and is configured in a mating relationship with duplexer concentric idler gear 30. Duplexer engaging idler gear 32 is capable of driving exit roll gear 34 in the second direction, such as an anticlockwise direction, opposite to the first direction.

Bell crank 36 may be swingably mounted on frame-mounted shaft 40 and is at least partially disposed between fuser concentric idler gear 24 and duplexer concentric idler gear 30. In one embodiment of the present invention, bell crank 36 may be an injection-molded plastic bell crank. In another embodiment of the present invention, bell crank 36 may be a wrap-around steel stamping bell crank. Bell crank 36 is capable of swinging to assume one of a first position and a second position. Bell crank 36 in the first position is capable of coupling fuser engaging idler gear 26 to exit roll gear 34 for driving exit roll gear 34 in the first direction. Bell crank 36 in the second position is capable of decoupling fuser engaging idler gear 26 from exit roll gear 34 and coupling duplexer engaging idler gear 32 with exit roll gear 34 for driving exit roll gear 34 in the second direction. Exit roll gear 34 driven in the first direction drives the media sheet partially or completely into the output bin of printing device 12. Exit roll gear 34 driven in the second direction drives the media sheet along the redrive path into printing device 12. An assembled view of the components of drive apparatus 20 is depicted in FIG. 2B.

Figure 2B:
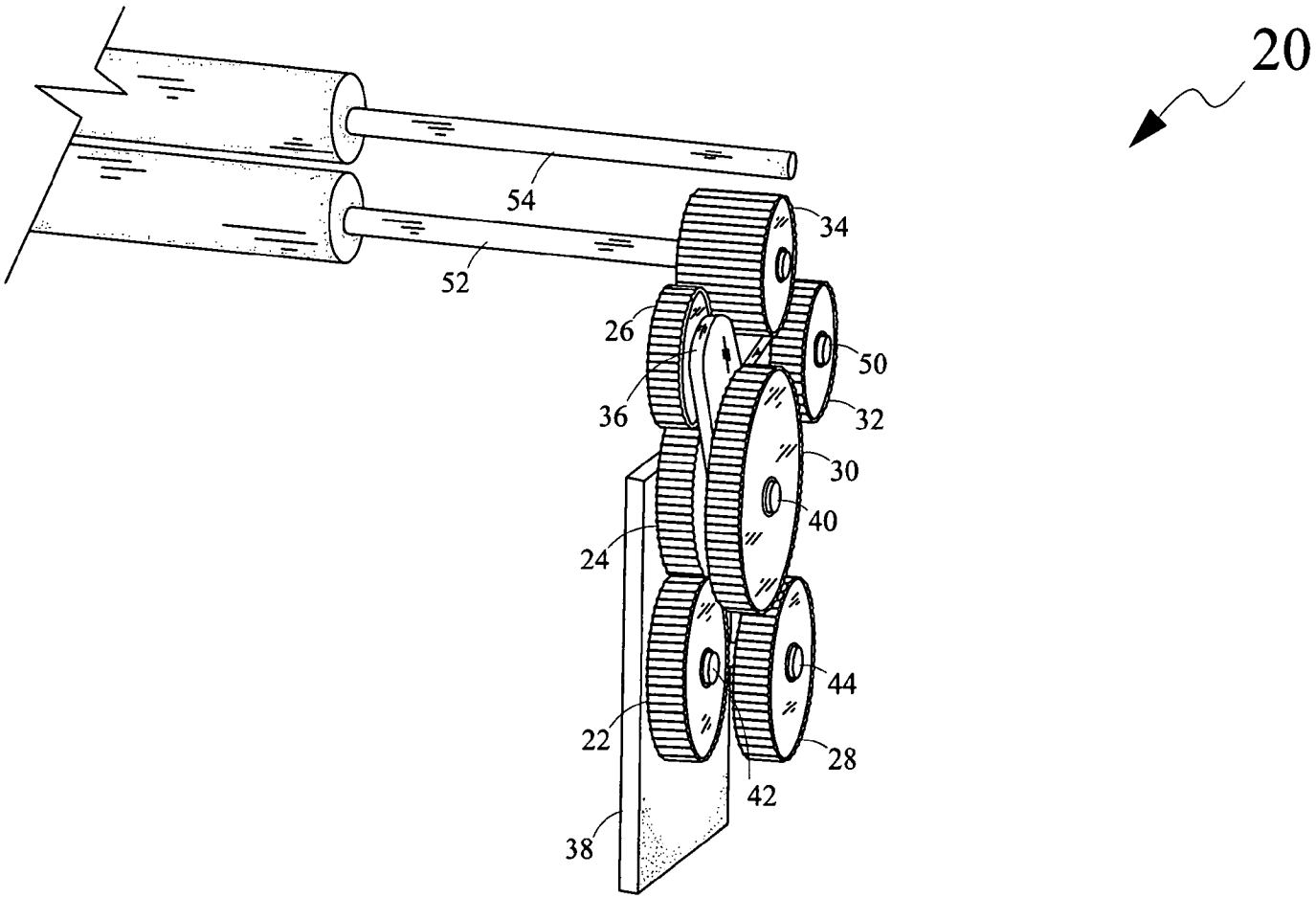
FIG. 2B is a schematic depiction of assembled components of the drive apparatus of FIG. 2A.

FIG. 2B is a schematic depiction of assembled components for configuring drive apparatus 20 of FIG. 2A. As explained in conjunction with FIG. 2A, fuser pinion gear 22 is mounted on fuser pinion gear shaft 42. Fuser concentric idler gear 24 is mounted on frame-mounted shaft 40 and is configured in a mating relationship with fuser pinion gear 22. Fuser engaging idler gear 26 is mounted on first shaft 46 and is configured in a mating relationship with fuser concentric idler gear 24. Duplexer pinion gear 28 is mounted on duplexer pinion gear shaft 44. Duplexer concentric idler gear 30 is mounted on frame-mounted shaft 40 and is configured in a mating relationship with duplexer pinion gear 28. Duplexer engaging idler gear 32 is mounted on second shaft 50 and is configured in a mating relationship with duplexer concentric idler gear 30.

Bell crank 36 is swingably mounted on frame-mounted shaft 40 and is completely disposed in-between fuser concentric idler gear 24 and duplexer concentric idler gear 30 and is capable of swinging to assume one of the first position and the second position. In FIG. 2B and for the purpose of the description herein, bell crank 36 is depicted to be completely disposed in-between fuser concentric idler gear 24 and duplexer concentric idler gear 30. It will be evident to those skilled in the art that bell crank 36 may be partially disposed in-between fuser concentric idler gear 24 and duplexer concentric idler gear 30 with only the first lateral surface mounting first shaft 46 and second lateral surface 48 mounting second shaft 50 disposed in-between fuser concentric idler gear 24 and duplexer concentric idler gear 30. Exit roll gear 34 is mounted on exit roll gear shaft 52 and forms the exit nip with the roll (not shown) for exiting the media sheets either partially or completely into the output bin of printing device 12. Bell crank 36 in the first position couples fuser engaging idler gear 26 to exit roll gear 34 for driving exit roll gear 34 in the first direction. Bell crank 36 in the second position decouples fuser engaging idler gear 26 from exit roll gear 34 and couples duplexer engaging idler gear 32 with exit roll gear 34 for driving exit roll gear 34 in the second direction.

Figure 3:
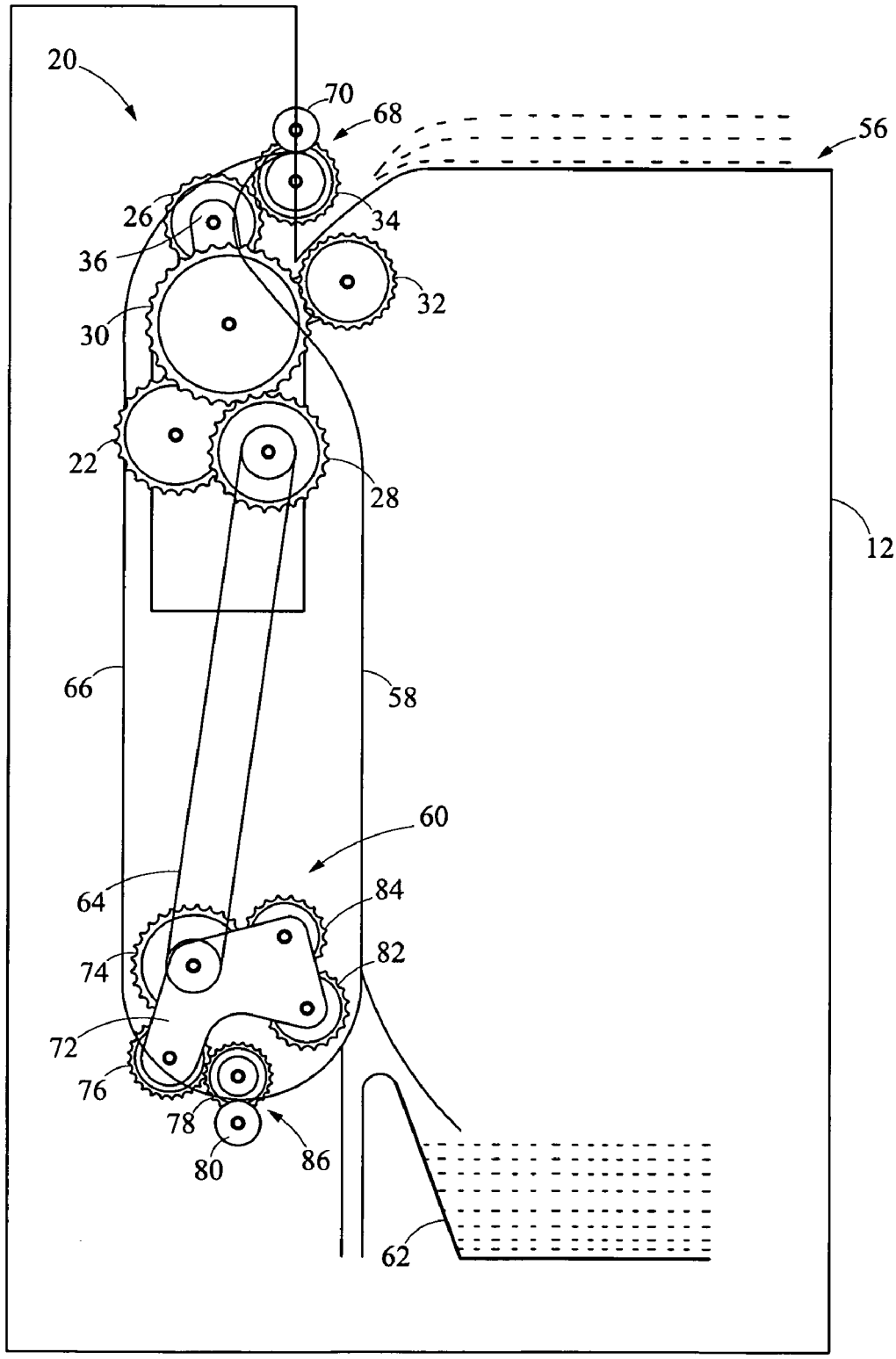
FIG. 3 is a schematic depiction of the drive apparatus of FIG. 2A for driving media sheets in a printing device embodying the present invention.

Referring now to FIG. 3, there is shown a schematic depiction of drive apparatus 20 in printing device 12 for driving the media sheets in printing device 12 embodying the present invention. Further, description of FIG. 3, also describes a method of driving the media sheets in printing device 12.

As shown in FIG. 3, drive apparatus 20 in printing device 12 is placed at a position such that exit roll gear 34 is capable of driving the media sheets into an output bin 56 of printing device 12. A media sheet traces a printing path 58 to traverse towards exit roll gear 34 of drive apparatus 20. Output bin 56 serves as an area for receiving printed media sheets as well as an area where a leading edge of the media sheet momentarily sticks out before being re-driven into printing device 12. In FIG. 3, drive apparatus 20 is shown to include a direction rectifying unit 60 (explained in conjunction with FIGS. 4 and 5) for rectifying direction of a path (hereinafter referred to as a media path) traversed by the media sheet in printing device 12. Only the media path, an input media tray 62, drive apparatus 20 including direction rectifying unit 60 and a belt pulley 64 coupling duplexer pinion gear 28 of drive apparatus 20 to direction rectifying unit 60 are depicted in FIG. 3. Those skilled in the art will recognize that printing device 12 will also include motors such as a fuser motor and a duplexer motor, a controller, a user interface and one or more cartridges as explained in conjunction with FIG. 1.

The media path in printing device 12 includes printing path 58 and a redrive path 66. A media sheet from input media tray 62 is directed in an upward direction and is driven along printing path 58 towards drive apparatus 20. Input media tray 62 may be a tray, which supplies the media sheets to printing device 12 and may be configured within or outside of printing device 12. Typically the media sheets are configured with two printable sides including a first side and a second side. Further, the media sheet has a first edge (not shown) and a second edge (not shown). During printing of the first side of the media sheet, the first edge is a leading edge of the media sheet that traces printing path 58 and the second edge becomes a trailing edge.

Printing path 58 may be configured to pass through a printing region including one or more print cartridges for printing on the first side of the media sheet. Those skilled in the art will recognize that printing device 12 may comprise media path rolls disposed throughout the media path, for continuously moving the media sheet along printing path 58 and redrive path 66. More specifically, a portion of the media sheet, for which printing is completed, continuously moves towards exit roll gear 34.

Further, subsequent to the printing on the first side of the media sheet, the leading edge of the media sheet, i.e., the first edge is guided through an exit nip 68 that is configured between exit roll gear 34 and a roll 70 as explained in conjunction with FIG. 2A. In an embodiment of the present invention, as represented in FIG. 3, during the printing on the first side of the media sheet, exit roll gear 34 rotates in a clockwise direction for driving the media sheet from exit nip 68. After the completion of the printing on the first side of the media sheet, the media sheet is exited partially from exit nip 68 such that the first edge of the media sheet lies outside of exit nip 68 and second edge of the media sheet is gripped in exit nip 68. After the completion of the printing on the first side of the media sheet, direction of rotation of exit roll gear 34 is reversed and exit roll gear 34 starts rotating in the anticlockwise direction. As a result of reversal of direction of rotation of exit roll gear 34, trailing edge, i.e., second edge of the media sheet which is gripped in exit nip 68, starts re-feeding along redrive path 66 of the media path. It will be apparent to persons skilled in the art that the second edge of the media sheet now becomes a leading edge and correspondingly the first edge becomes a trailing edge during the printing of the second side of the media sheet.

Redrive path 66 includes the media path rolls, which are configured to transfer the media sheet back to the printing region. It will be apparent to persons skilled in the art that re-feeding the media sheet along redrive path 66 turns around the media sheet for facing the second side of the media sheet towards a printing mechanism of the printing region. The printing region further performs the printing process on the second side of the media sheet which may then be driven towards exit roll gear 34. On completion of printing on both sides of the media sheet (duplex printing), direction of rotation of exit roll gear 34 is reversed and exit roll gear 34 rotates in clockwise direction to exit the media sheet completely into output bin 56.

The fuser drive train and the duplexer drive train, explained in conjunction with FIG. 2A, of drive apparatus 20 may alternatively drive exit roll gear 34 for driving the media sheets. For driving the fuser drive train, a fuser motor input is continuously provided using a fuser motor (not shown) to fuser pinion gear 22. The fuser motor input may typically be in form of an electrical power supply capable of revolving fuser pinion gear shaft 42 for driving fuser pinion gear 22. Alternatively, the fuser motor input may be provided to one or more gears abuttingly coupled and placed in a mating relationship with fuser pinion gear 22 for driving fuser pinion gear 22. Fuser pinion gear 22 receives the fuser motor input and rotates at a constant speed and a direction as dictated by various constraints such as a power of the fuser motor input, friction between fuser pinion gear 22 and fuser concentric idler gear 24 and number of drive gears employed for driving fuser pinion gear 22. In an embodiment of the present invention, fuser pinion gear 22 rotates in a counter-clockwise (CCW) direction. Fuser concentric idler gear 24 configured in a mating relationship with fuser pinion gear 22 rotates in a clockwise (CW) direction. The CW direction of rotation of fuser concentric idler gear 24 drives fuser engaging idler gear 26, configured in a mating relationship with fuser concentric idler gear 24, in CCW direction. The CCW direction of rotation of fuser engaging idler gear 26 drives exit roll gear 34 in the CW direction for driving media sheets into output bin 56 of printing device 12.

In an embodiment of the present invention, fuser concentric idler gear 24, when driven, is configured to minimize friction with bell crank 36. Further, a line of action of a force vector from a tooth of fuser engaging idler gear 26 to a tooth of exit roll gear 34 at a contact point, passes to a right side of frame-mounted shaft 40, having an effect of imparting a CW swinging force on bell crank 36 and latching fuser engaging idler gear 26 and exit roll gear 34 in contact when the fuser drive train is driven. The line of action of the force vector is set to pass to the right side of frame-mounted shaft 40 by a combination of a selection of pressure angles of gears in drive apparatus 20, respective diameters of the gears in drive apparatus 20, and the relative center distances from frame-mounted shaft 40 to first shaft 46 and from frame-mounted shaft 40 to exit roll gear shaft 52.

If the fuser motor input is stopped, such as, by switching printing device 12 to an OFF state, bell crank 36 maintains its first position. In an embodiment of the present invention, bell crank 36 maintains its first position by a force of gravity acting on a centroid of a combination of parts including bell crank 36, fuser engaging idler gear 26, and duplexer engaging idler gear 32 directed to the right side of the frame-mounted shaft 40. Fuser engaging idler gear 26 coupled to exit roll gear 34 thus serves as a default position, when the fuser motor input is stopped, such as, by switching printing device 12 to the OFF state.

For duplex printing, direction of rotation of exit roll gear 34 is reversed for driving a media sheet along redrive path 66 into printing device 12. Direction of rotation of exit roll gear 34 is reversed by driving the duplexer drive train. For driving the duplexer drive train, a duplexer motor input is provided using a duplexer motor (not shown) to duplexer pinion gear 28. The duplexer motor input may typically be in form of an electrical power supply capable of revolving duplexer pinion gear shaft 44 for driving duplexer pinion gear 28. Alternatively, the duplexer motor input may be provided to one or more gears abuttingly coupled and placed in a mating relationship with duplexer pinion gear 28 for driving duplexer pinion gear 28. In an embodiment of the present invention, duplexer pinion gear 28 rotates in the CW direction. Duplexer concentric idler gear 30 configured in a mating relationship with duplexer pinion gear 28, rotates in the CCW direction. The CCW direction of rotation of duplexer concentric idler gear 30 drives duplexer engaging idler gear 32 in the CW direction.

Duplexer concentric idler gear 30, when driven, is configured to provide a constant friction to bell crank 36. A constant friction contact may be achieved by using, for example a friction washer or a fluid damper coupling arrangement. The CCW direction of rotation of duplexer concentric idler gear 30 swings bell crank 36 to assume the second position, decoupling fuser engaging idler gear 26 from exit roll gear 34 and coupling duplexer engaging idler gear 32 to exit roll gear 34 for driving exit roll gear 34 in the CCW direction. The CCW direction of rotation of exit roll gear 34 drives the media sheets along redrive path 66 into printing device 12. It will be evident to those skilled in the art that the CW and the CCW swinging of bell crank 36 may be controlled by utilizing combinations of a gravitational force, a rotational friction, a latch-in force under drive, and the like. In an embodiment of the present invention, the rotational friction may swing bell crank 36 in the CW direction and the latch-in force under drive may maintain position of bell crank 36 in the CW direction. In another embodiment of the present invention, the rotational friction for swinging bell crank 36 may be accomplished by utilizing the friction washer or the fluid damper coupling arrangement at first shaft 46 or second shaft 50 instead of frame-mounted shaft 40.

For duplex printing, the duplexer motor input may be provided to duplexer pinion gear 28 based on a pre-defined criterion. The pre-defined criterion may be, for example, traversing of a trailing edge (second edge) of the media sheet to a pre-defined position relative to an exit roll coupled to exit roll gear 34. The pre-defined position may be for example, when the trailing edge is gripped by exit nip 68 and the leading edge of the media sheet has peek-a-booed, that is exited momentarily, into output bin 56 of printing device 12. Those skilled in the art will recognize that the duplexer motor input may be provided at any such pre-defined position of the media sheet in printing device 12. Providing continuous duplexer motor input to the duplexer drive train maintains the CCW direction of rotation of exit roll gear 34 on account of the constant friction contact of bell crank 36 with duplexer concentric idler gear 30 coupling duplexer engaging idler gear 32 with exit roll gear 34.

The direction of rotation of exit roll gear 34 may be reverted to the CW rotation by briefly reversing direction of the duplexer motor input for rotating duplexer pinion gear 28 in the CCW direction. Those skilled in the art will recognize that the duplexer motor may be a bi-directional motor with encoder feedback for velocity control. The direction of the duplexer motor input may be reversed when trailing edge of the media sheet has left exit roll gear 34 and may be driven by the drive rolls towards the printing region for printing on the second side of the media sheet. Reversing the direction of the duplexer motor input causes duplexer pinion gear 28 to rotate in the CCW direction thereby rotating duplexer concentric idler gear 30 in the CW direction. The constant friction contact between bell crank 36 and duplexer concentric idler gear 30 swings bell crank 36 in the CW direction to assume the first position. Bell crank 36 in the first position decouples duplexer engaging idler gear 32 from exit roll gear 34 and couples fuser engaging idler gear 26 rotating in the CCW direction to exit roll gear 34. Fuser engaging idler gear 26 rotating in the CCW direction drives exit roll gear 34 in the CW direction for driving the media sheets into output bin 56 of printing device 12.

Direction rectifying unit 60 includes a swinging bell crank 72, a concentric drive gear 74, a first engaging drive gear 76, a first roller gear 78, a first drive roll 80, a second engaging drive gear 82 and an idler gear 84. All gears of direction rectifying unit 60 lie in same plane. Concentric drive gear 74 is configured in a mating relationship with first engaging drive gear 76. First engaging drive gear 76 is capable of coupling with first roller gear 78 for driving first roller gear 78. Concentric drive gear 74 is also configured in mating relationship with idler gear 84. Idler gear 84 is configured in mating relationship with second engaging drive gear 82. Second engaging drive gear 82 is capable of coupling with first roller gear 78 for driving first roller gear 78. First roller gear 78 is mounted on drive roll which is abuttingly coupled to first drive roll 80 forming a first nip 86 for directing path of the media sheet from redrive path 66 towards printing path 58 for the duplex printing. Swinging bell crank 72 is swingably mounted on a shaft bearing concentric drive gear 74 and is capable of swinging from a first position to a second position. In the first position, swinging bell crank 72 couples first engaging drive gear 76 to first roller gear 78 for driving first roller gear 78. In the second position, swinging bell crank 72 decouples first engaging drive gear 76 from first roller gear 78 and couples second engaging drive gear 82 with first roller gear 78 for driving first roller gear 78.

Concentric drive gear 74 driven in the CCW direction rotates first engaging drive gear 76 in the CW direction. Concentric drive gear 74 is configured to provide friction to swinging bell crank 72 and the CCW rotation of concentric drive gear 74 swings swinging bell crank 72 to assume the first position coupling first engaging drive gear 76 to first roller gear 78. The CW direction of rotation of first engaging drive gear 76 drives first roller gear 78 in the CCW direction. First roller gear 78 driven in the CCW direction drives a media sheet from redrive path 66 to printing path 58 through first nip 86 formed by the drive roll of first roller gear 78 abuttingly coupled to first drive roll 80.

Reversing direction of rotation of concentric drive gear 74 to the CW rotation rotates idler gear 84 in the CCW direction. Friction between concentric drive gear 74 and swinging bell crank 72 and the CW rotation of concentric drive gear 74 swings swinging bell crank 72 to assume the second position. The second position of swinging bell crank 72 decouples first engaging drive gear 76 from first roller gear 78 and couples second engaging drive gear 82 to first roller gear 78. The CCW rotation of idler gear 84 rotates second engaging drive gear 82 in the CW direction. The CW rotation of second engaging drive gear 82 drives first roller gear 78 in the CCW direction. First roller gear 78 driven in the CCW direction drives the media sheet from redrive path 66 to printing path 58 through first nip 86. Direction of rotation of first roller gear 78 for driving media sheets from redrive path 66 to printing path 58 is maintained irrespective of direction of rotation of concentric drive gear 74.

Belt pulley 64 couples duplexer pinion gear 28 to concentric drive gear 74 of direction rectifying unit 60 for driving concentric drive gear 74 in one of the CW direction and a CCW direction. Driving duplexer pinion gear 28 in the CW direction using the duplexer motor input from the duplexer motor (not shown) drives concentric drive gear 74 in the CW direction. Similarly, driving duplexer pinion gear 28 in the CCW direction drives concentric drive gear 74 in the CCW direction.

Duplexer pinion gear 28 driven in the CCW direction decouples duplexer engaging idler gear 32 from exit roll gear 34 and engages fuser engaging idler gear 26 to exit roll gear 34 for driving exit roll gear 34 in the CW direction. The duplexer motor input may be provided to drive duplexer pinion gear 28 in the CCW direction when the trailing edge, i.e. the second edge, of the media sheet has left exit nip 68 and entered redrive path 66. The speed of rotation of duplexer pinion gear 28 in the CCW direction may be increased with a corresponding increase in the CCW rotation of concentric drive gear 74, thereby increasing speed for driving the media sheet along redrive path 66. The speed for driving the media sheets along redrive path 66 may be varied by varying the duplexer motor input. Thus the speed of the redrive of the media sheet may be varied independent of fuser motor input including, stopping it completely during parking. It will be evident to a person skilled in the art that the speed of the media sheet may be varied from zero to multiples of a nominal speed defined for printing device 12. Further, persons skilled in the art will recognize that various configurations of direction rectifying unit 60 may be included in drive apparatus 20 for rectifying path traversed by the media sheet. One such configuration is explained in conjunction with FIG. 4.

Figure 4:
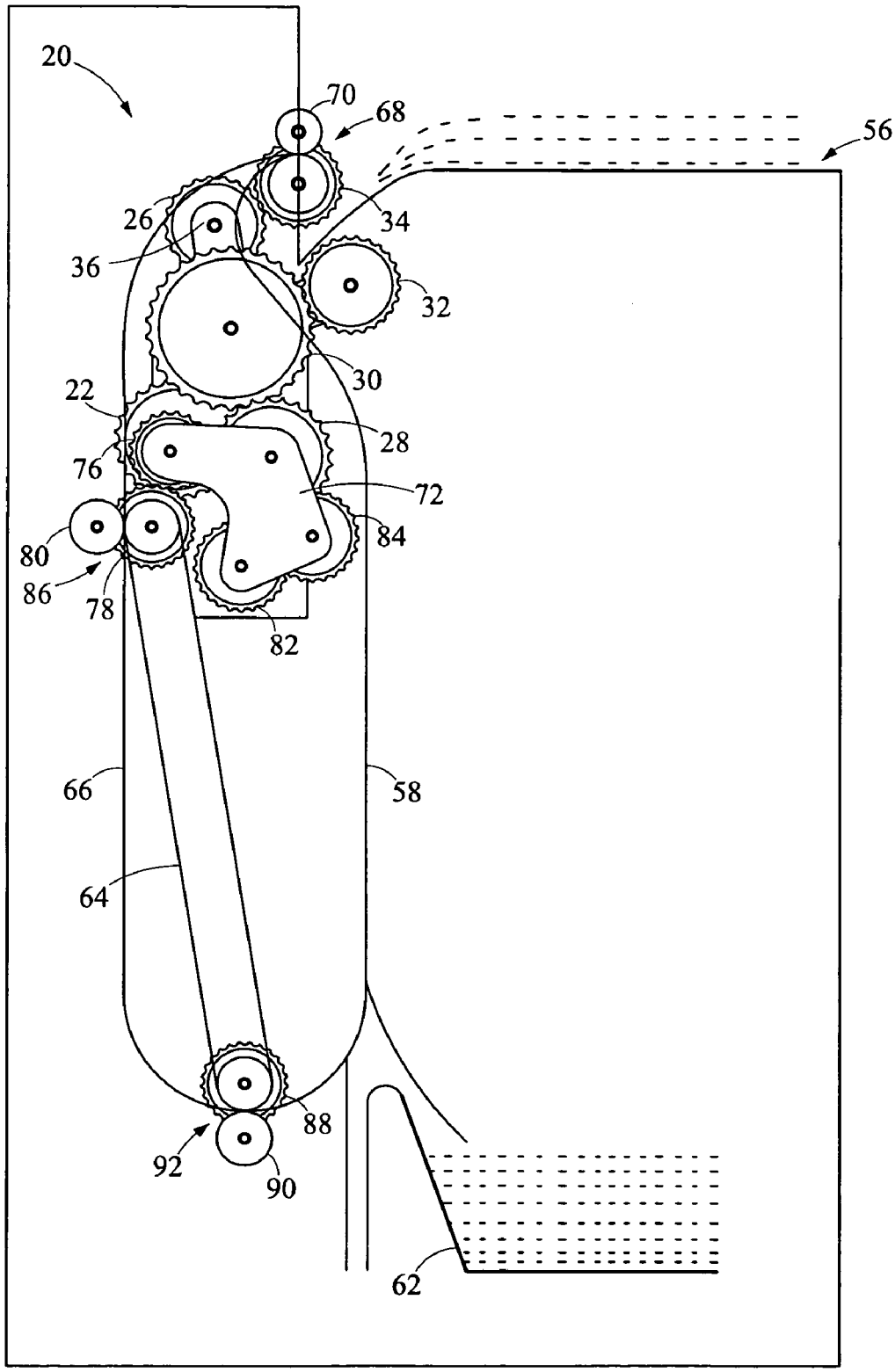
FIG. 4 is a schematic depiction of an exemplary direction rectifying unit of a drive apparatus in a printing device embodying the present invention.

FIG. 4 is a schematic depiction of an exemplary configuration of direction rectifying unit 60 of drive apparatus 20 in printing device 12 embodying the present invention. In the exemplary configuration of direction rectifying unit 60 of drive apparatus 20, number of gears used for rectifying path traversed by the media sheet is reduced by utilizing duplexer pinion gear 28 as concentric drive gear 74. Duplexer pinion gear 28 is configured in mating relationship with first engaging drive gear 76 and idler gear 84. First engaging drive gear 76 is capable of coupling with first roller gear 78 for driving first roller gear 78. Duplexer pinion gear 28 is also configured in mating relationship with idler gear 84. Idler gear 84 is configured in mating relationship with second engaging drive gear 82. Second engaging drive gear 82 is capable of coupling with first roller gear 78 for driving first roller gear 78. Swinging bell crank 72 is mounted on duplexer pinion gear shaft 44 and is swingably disposed to assume one of the first position and the second position. In the first position swinging bell crank 72 couples first engaging drive gear 76 to first roller gear 78 for driving first roller gear 78. In the second position, swinging bell crank 72 decouples first engaging drive gear 76 from first roller gear 78 and couples second engaging drive gear 82 with first roller gear 78 for driving first roller gear 78.

First roller gear 78 is mounted on the drive roll which is abuttingly coupled to first drive roll 80 forming first nip 86 for directing path of a media sheet. In FIG. 4, belt pulley 64 couples first roller gear 78 with a second roller gear 88 mounted on a drive roll abuttingly coupled to a second drive roll 90 for forming a second nip 92. As explained in conjunction with FIG. 3, first roller gear 78 is driven in the CCW direction irrespective of direction of rotation of duplexer pinion gear 28. First roller gear 78 driven in the CCW direction drives second roller gear 88 in the CCW direction for driving a media sheet from redrive path 66 to printing path 58 through second nip 92.

Drive apparatus 20 as explained herein may also be referred to as "sandwiched swing arm assembly" as the fuser drive train and the duplexer drive train lie in parallel planes with bell crank 36 at least partially disposed in-between the fuser drive train and the duplexer drive train and capable of swinging for driving exit roll gear 34. Providing the duplexer motor input to duplexer pinion gear 28 for driving the duplexer drive train swings bell crank 36 from the first position to the second position, decoupling fuser engaging idler gear 26 from exit roll gear 34 and coupling duplexer engaging idler gear 32 to exit roll gear 34 thereby reversing the direction of rotation of exit roll gear 34. Thus, the sandwiched swing arm assembly precludes the need of a dedicated actuator for reversing the direction of exit roll gear 34 for driving the media sheet back along the media path in printing device 12. Further, reversing the direction of the duplexer motor input, for an instant, swings bell crank 36 from the second position to the first position, decoupling duplexer engaging idler gear 32 from exit roll gear 34 and coupling fuser engaging idler gear 26 to exit roll gear 34 thereby returning driving of exit roll gear 34 to the fuser drive train. Also, drive apparatus 20 permits the duplexer motor to participate in driving exit roll gear 34 without having to drive exit roll gear 34 during simplex printing of the media sheet. Furthermore, as explained in conjunction with FIGS. 3 and 4, drive apparatus 20 permits the duplexer motor autonomy to drive the media sheet back along redrive path 66 into printing device 12, thereby allowing the duplexer motor to vary speed of redrive of the media sheet into printing device 12.

The foregoing description of several methods and an embodiment of the present invention have been presented for purposes of illustration. It is not intended to be exhaustive or to limit the present invention to the precise steps and/or forms disclosed, and obviously many modifications and variations are possible in light of the above description. It is intended that the scope of the present invention be defined by the claims appended hereto.

What is claimed is:

1. A drive apparatus of a printing device, the drive apparatus comprising:

a fuser drive train, the fuser drive train comprising a fuser pinion gear capable of being driven by a fuser motor input, a fuser concentric idler gear capable of revolving on a frame-mounted shaft, the fuser concentric idler gear configured in a mating relationship with the fuser pinion gear, and a fuser engaging idler gear capable of revolving on a first shaft, the fuser engaging idler gear configured in a mating relationship with the fuser concentric idler gear;

a duplexer drive train, the duplexer drive train comprising a duplexer pinion gear capable of being driven by a duplexer motor input, a duplexer concentric idler gear capable of revolving on the frame-mounted shaft, the duplexer concentric idler gear configured in a mating relationship with the duplexer pinion gear, and a duplexer engaging idler gear capable of revolving on a second shaft, the duplexer engaging idler gear configured in a mating relationship with the duplexer concentric idler gear;

an exit roll gear, the exit roll gear capable of being driven in a first direction and a second direction; and a bell crank swingably mounted on the frame-mounted shaft, the bell crank at least partially disposed in-between the fuser concentric idler gear and the duplexer concentric idler gear, the bell crank comprising a first lateral surface and a second lateral surface, wherein the first shaft is mounted on the first lateral surface and the second shaft mounted on the second lateral surface, and, wherein the bell crank is capable of swinging to assume one of a first position and a second position, and, wherein the bell crank in the first position is capable of coupling the fuser engaging idler gear to the exit roll gear for driving the exit roll gear in the first direction, and, wherein the bell crank in the second position is capable of decoupling the fuser engaging idler gear from the exit roll gear and coupling the duplexer engaging idler gear to the exit roll gear for driving the exit roll gear in the second direction.

2. The drive apparatus of the printing device of claim 1 wherein the exit roll gear driven in the first direction is capable of driving a media sheet into an output bin of the printing device.

3. The drive apparatus of the printing device of claim 1 wherein the exit roll gear driven in the second direction is capable of driving a media sheet along a redrive path into the printing device.

4. The drive apparatus of the printing device of claim 3 wherein a speed for driving the media sheet along the redrive path is varied by varying the duplexer motor input.

5. The drive apparatus of the printing device of claim 3 wherein a speed for driving the media sheet along the redrive path is varied independent of the fuser motor input.

6. The drive apparatus of the printing device of claim 1 wherein the duplexer motor input to the duplexer pinion gear is capable of swinging the bell crank from the first position to the second position for decoupling the fuser engaging idler gear from the exit roll gear and coupling the duplexer engaging idler gear to the exit roll gear.

7. The drive apparatus of the printing device of claim 1 wherein reversing a direction of the duplexer motor input to the duplexer pinion gear is capable of swinging the bell crank from the second position to the first position for decoupling the duplexer engaging idler gear from the exit roll gear and coupling the fuser engaging idler gear to the exit roll gear.

8. The drive apparatus of the printing device of claim 1 wherein the duplexer pinion gear is driven by the duplexer motor input when a trailing edge of a media sheet traverses to a pre-defined position relative to an exit roll coupled to the exit roll gear.

9. The drive apparatus of the printing device of claim 1 further comprising a direction rectifying unit for rectifying direction of path traversed by a media sheet in the printing device.

10. The drive apparatus of the printing device of claim 1 wherein the fuser concentric idler gear, when driven, is configured to minimize friction with the bell crank.

11. The drive apparatus of the printing device of claim 1 wherein the duplexer concentric idler gear, when driven, is configured to provide constant friction to the bell crank.

12. A method for driving media sheets in a printing device, the method comprising:

providing a fuser motor input for driving a fuser drive train to drive an exit roll gear in a first direction; and providing a duplexer motor input based on a pre-defined criterion for driving a duplexer drive train, the duplexer drive train driving the exit roll gear in a second direction, wherein driving the duplexer drive train swings a bell crank at least partially disposed in-between the fuser drive train and the duplexer drive train from a first position to a second position, and, wherein the bell crank in the first position couples the fuser drive train to the exit roll gear for driving the exit roll gear in the first direction, and, wherein driving the exit roll gear in the first direction is capable of driving a media sheet into an output bin of the printing device, and, wherein the bell crank in the second position decouples the fuser drive train from driving the exit roll gear and couples the duplexer drive train to the exit roll gear for driving the exit roll gear in the second direction, and, wherein driving the exit roll gear in the second direction is capable of driving the media sheet along a redrive path into the printing device.

13. The method of claim 12 wherein a speed of driving the media sheet into the redrive path is varied by varying the duplexer motor input.

14. The method of claim 12 wherein the pre-defined criterion comprises traversing of a trailing edge of the media sheet to a pre-defined position relative to an exit roll coupled to the exit roll gear.

15. The method of claim 12 further comprising reversing a direction of the duplexer motor input for swinging the bell crank from the second position to the first position for decoupling the duplexer drive train from driving the exit roll gear and coupling the fuser drive train to the exit roll gear for driving the exit roll gear.

* * * * *